US009827655B2

(12) United States Patent
Owens et al.

(10) Patent No.: US 9,827,655 B2
(45) Date of Patent: Nov. 28, 2017

(54) SEAL EXTRACTION TOOL

(71) Applicant: ROLLS-ROYCE PLC, London (GB)

(72) Inventors: Thomas Reginald Owens, Derby (GB); James Mark Walter, Derby (GB)

(73) Assignee: ROLLS-ROYCE PLC, London (GB)

( * ) Notice: Subject to any disclaimer, the term of this patent is extended or adjusted under 35 U.S.C. 154(b) by 14 days.

(21) Appl. No.: 14/960,923

(22) Filed: Dec. 7, 2015

(65) Prior Publication Data

US 2016/0207183 A1 Jul. 21, 2016

(30) Foreign Application Priority Data

Jan. 15, 2015 (GB) ..... 1500619.0

(51) Int. Cl.
*B25B 27/06* (2006.01)
*B25B 27/00* (2006.01)

(52) U.S. Cl.
CPC ..... *B25B 27/0028* (2013.01); *B25B 27/062* (2013.01); *Y10T 29/53887* (2015.01)

(58) Field of Classification Search
CPC ..... B25B 27/06; B25B 27/062; B25B 27/02; Y10T 29/53878; Y10T 29/53887
See application file for complete search history.

(56) References Cited

U.S. PATENT DOCUMENTS 1,456,943 A * 5/1923 Smith ..... E21B 31/18 294/100
2,386,253 A * 10/1945 Meyer ..... B25B 27/062 29/265
2,646,619 A * 7/1953 McCord ..... B25B 27/062 29/263

(Continued)

FOREIGN PATENT DOCUMENTS

DE 9309501 U1 8/1993
EP 2806163 A1 11/2014

(Continued)

*Primary Examiner* — Larry E Waggle, Jr.
*Assistant Examiner* — Tyrone V Hall, Jr.
(74) *Attorney, Agent, or Firm* — Oliff PLC

(57) ABSTRACT

Tool for extracting annular carbon face seal from bore of equipment which seal is installed. Tool has extraction-tube for insertion into bore at entrance so, when extraction-tube is fully inserted into bore, multi-legged collet formed at distal-end of extraction-tube located within seal and proximal-end of extraction-tube accessible at entrance of bore. Tool has elongate-member extending along central passage of extraction-tube. Wedge element provided at distal-end of elongate-member located at mouth of collet. Proximal-end of elongate-member accessible at proximal-end of extraction-tube. Tool has support for reacting axial extraction force applied to extraction-tube to equipment. Tool has first-actuator at proximal-end of elongate-member. Tool configured so first-actuator causes wedge element to be pulled into collet, thereby expanding collet and causing to grip inner surface of seal. Tool has actuation second-actuator which operatively connects extraction-tube and support arrangement so actuation of second-actuator causes axial extraction force to extraction tube, whereby extraction force, reacted to equipment, extracts seal from bore when seal is gripped by collet.

6 Claims, 4 Drawing Sheets

(56) References Cited

U.S. PATENT DOCUMENTS 2,719,747 A * 10/1955 Layne ..... B66C 1/54 29/263
3,055,093 A 9/1962 Ruble
3,252,210 A * 5/1966 Bowden ..... B25B 9/00 29/213.1
4,003,119 A * 1/1977 Hugh ..... B25D 1/16 29/254
4,429,447 A * 2/1984 Davis ..... B25B 27/06 29/262
4,507,837 A * 4/1985 Hinkle ..... B25B 27/023 29/262
4,507,838 A * 4/1985 Hacker ..... B25B 27/062 29/263
4,724,608 A * 2/1988 Parrott ..... B25B 27/023 29/253
4,852,235 A * 8/1989 Trease ..... B25B 27/023 29/263
5,276,951 A * 1/1994 Gluszek ..... B25B 27/062 29/265
5,355,574 A 10/1994 Zweekly et al.
5,379,503 A * 1/1995 Fakult ..... B25B 27/062 29/265
5,406,685 A * 4/1995 Harmand ..... B25B 27/06 29/235
5,408,732 A * 4/1995 Anfuso ..... B25B 27/023 29/263
5,709,018 A * 1/1998 Dugan ..... B23P 19/084 29/235
5,787,561 A * 8/1998 Harmand ..... B25B 27/06 29/235
7,146,697 B2 * 12/2006 Chan ..... B25B 27/0028 29/235
8,011,671 B2 9/2011 Madigan
8,978,222 B2 * 3/2015 Ferreira ..... B25B 27/062 29/255
9,174,331 B1 * 11/2015 Coghlan ..... B25B 27/062
2012/0319355 A1 12/2012 Blewett et al.

FOREIGN PATENT DOCUMENTS

FR 1115341 A 4/1956
TW M271984 U 8/2005

* cited by examiner

SEAL EXTRACTION TOOL

FIELD OF THE INVENTION

The present invention relates to a tool for extracting an annular carbon face seal from a bore of equipment in which the seal is installed.

BACKGROUND OF THE INVENTION

A typical fuel pumping system for an aero-engine comprises a low pressure (LP) pumping stage operable to draw fuel from a fuel tank, and supply the fuel at boosted pressure to the inlet of a high pressure (HP) pumping stage. The LP pumping stage may comprise a centrifugal impeller pump while the HP pumping stage may comprise a positive displacement gear pump having one or more pinion gear pairs.

The inter-stage flow between LP and HP pumping stages may be used to cool engine lubrication oil in a fuel/oil heat exchanger.

The journal bearings and gear elements of an HP pumping stage gear pump are typically lubricated by the fluid (aviation engine fuel) being pumped, due to the impracticalities of providing appropriate sealing.

FIG. 1 shows schematically a cross-section through part of a fuel pumping unit 30 which supplies fuel to the combustion equipment of a gas turbine aero-engine. The pumping unit 30 has an HP stage and an LP stage.

The HP stage is contained in an HP housing 31, and comprises a positive displacement pump in the form of two gear pumps: a secondary gear pump 32 and a primary gear pump. The secondary gear pump 32 includes a driver gear 34, and a driven gear 36, the teeth of which are meshed with one another, the gears 34, 36 being sandwiched between bearing blocks 38. The secondary gear pump 32 incorporates an input drive shaft 40 arranged to be driven by a drive output pad of an associated accessory gear box (AGB). The drive shaft 40 is arranged to drive the gear 34 for rotation, which in turn, by nature of the meshing of the gear teeth, drives the gear 36 for rotation. Rotation of the gears 34, 36 positively displaces fuel from an inlet side of the secondary gear pump 32 to an output side thereof, pressurising the fuel at the output side. The primary gear pump is driven through a secondary drive shaft 103 that connects driven gear 36 and a drive gear 100 of the primary gear pump. A driven gear (not shown in FIG. 1) of the primary gear pump meshes with the drive gear 100. An extension shaft 42, forming part of the drive shaft 40, is fixed into the drive gear 34, onto which is mounted an impeller 50 of a centrifugal pump forming part of the LP stage. In use, rotation of the input drive shaft 40 by the AGB drives the secondary gear pump 32, the primary gear pump, and the LP centrifugal pump.

The bearing blocks 38 include annular carbon face seals (CFSs), in which a carbon seal is urged against a harder surface by a spring element, in use the carbon seal and the harder surface rotating relative to each other with the interface between them forming the seal. Insertion and extraction of a CFS into the blind bore which contains the shaft of the respective gear 34, 36 can be highly dependent on the skill and experience of an operator. Typically, the spring element of the CFS has to be fully compressed upon location and then allowed to relax. Furthermore there may be CFS location pins that need to be correctly inserted in their location bores. For extraction, a conventional tool can be used in which two legs are inserted into the location pin bores, and the CFS is then "walked out" of its installation.

However, the position of the pin bores can make it difficult to correctly insert the legs, resulting in failure of the tool to locate the CFS face and extract the CFS. The "walking out" extraction process can also result in a damaged CFS that needs to be replaced, and also potentially results in damage (scouring) to the pump casting.

SUMMARY OF THE INVENTION

An aim of the present invention is to provide a tool which addresses shortcomings of the conventional tool.

Accordingly, in a first aspect, the present invention provides a tool for extracting an annular carbon face seal from a bore of equipment in which the seal is installed, the tool having:

- an extraction tube for insertion into the bore at an entrance thereof such that, when the extraction tube is fully inserted into the bore, a multi-legged collet formed at a distal end of the extraction tube is located within the seal and a proximal end of the extraction tube is accessible at the entrance of the bore;
- an elongate member which extends along the central passage of the extraction tube, a wedge element provided at a distal end of the elongate member being located at a mouth of the collet, and a proximal end of the elongate member being accessible at the proximal end of the extraction tube;
- a support arrangement for reacting an axial extraction force applied to the extraction tube to the equipment;
- a first actuator located at the proximal end of the elongate member, the tool being configured such that actuation of the first actuator causes the wedge element to be pulled into collet, thereby expanding the collet and causing it to grip an inner surface of the seal; and
- a second actuator which operatively connects the extraction tube and the support arrangement such that actuation of the second actuator causes the axial extraction force to be applied to the extraction tube, whereby the extraction force, reacted to the equipment, extracts the seal from the bore when the seal is gripped by the collet.

Advantageously, by gripping the seal with the collet, the need to insert tool features into location pin bores can be avoided, and further the tool can be configured so that precise axial alignment of the collet with the seal is easy to achieve. In addition, the tool, by applying the axial extraction force, can avoid the "walking out" extraction process of the conventional tool, helping to reduce damage to both the seal and the bore.

In a second aspect, the present invention provides the use of the tool according to the first aspect to extract an annular carbon face seal from a bore of equipment in which the seal is installed. For example, a method of extracting an annular carbon face seal from a bore of equipment in which the seal is installed may include:

- providing the tool of the first aspect;
- positioning the support arrangement to react an axial extraction force applied to the extraction tube to the equipment, and inserting the extraction tube into the bore at an entrance thereof such that, when the extraction tube is fully inserted into the bore, the multi-legged collet is located within the seal and the proximal end of the extraction tube is accessible at the entrance of the bore;
- actuating the first actuator to pull the wedge element into the collet, thereby expanding the collet and causing it to grip an inner surface of the seal; and actuating the second actuator to apply the axial extraction force to the extraction tube, thereby extracting the seal from the bore.

Optional features of the invention will now be set out. These are applicable singly or in any combination with any aspect of the invention.

The equipment may be a gear pump.

The first and/or the second actuator may be manually operable.

Preferably the proximal end of the extraction tube is made accessible by projecting from the entrance of the bore. Similarly, the proximal end of the elongate member can be made accessible by projecting from the central passage of the extraction tube.

The collet may have at least four, and preferably six or more, circumferentially arranged legs. By having such a number of legs, the contact area between the expanded collet and the inner surface of the seal can be increased, thereby reducing the risk of damage to the seal.

Each leg of the collet may have a radially outwardly projecting portion which, when the collet is expanded, grips a recessed inner surface of the seal.

The first actuator may be a rotatable first actuator, the tool being configured to have a first threaded connection such that rotation of the first actuator causes the wedge element to be pulled into collet, thereby expanding the collet and causing it to grip an inner surface of the seal. The first actuator can be in the form of a dial coaxial with the elongate member.

For example, the first threaded connection can be a threaded connection between the elongate member and the extraction tube, the elongate member pulling out of the extraction tube and the wedge element rotating in the collet when the first actuator is rotated. In such a case, the wedge element is preferably axisymmetric about the axis of the extraction tube. For example, the wedge element can have a substantially spherical contact surface for contact with the collet. Indeed, the wedge element may be spheroidal. The tool may further have a spacer collar which is positionable between the first actuator and the proximal end of the extraction tube when the collet is fully expanded. Thus the spacer collar can not only be used to determine that the collet has fully expanded, but can also prevent inadvertent reversal of the first actuator and contraction of the collet.

As a different option to forming the first threaded connection between the elongate member and the extraction tube, the first threaded connection can be a threaded connection between the elongate member and the wedge element, the wedge element having an engagement formation which engages with a complimentary formation of the collet to prevent rotation of the wedge element in the collet when the first actuator is rotated. According to this option, the elongate member does not pull out of the extraction tube when the first actuator is rotated, but rather the wedge element travels along the elongate member.

The second actuator may be a rotatable second actuator which is threadingly connected to the extraction tube and is in a fixed axial relationship with the support arrangement such that rotation of the second actuator causes the axial extraction force to be applied to the extraction tube. The second actuator can be in the form of a dial coaxial with the extraction tube.

Although rotatable first and second actuators used in conjunction with threaded connections are convenient to implement, other forms of actuators known to the skilled person can be used in the tool, e.g. based on levers, cams, gears etc. In general such actuators should operate to magnify respective input forces and keep the tool concentric with the bore of the equipment.

The support arrangement may have an engagement formation for engaging with the equipment and preventing rotation of the support arrangement relative thereto.

The tool may have a stop arrangement to prevent the first actuator from actuating (e.g. rotating) further when the correct amount of collet expansion is achieved.

BRIEF DESCRIPTION OF THE DRAWINGS

Embodiments of the invention will now be described by way of example with reference to the accompanying drawings in which.

DETAILED DESCRIPTION AND FURTHER OPTIONAL FEATURES OF THE INVENTION

Figure 1:
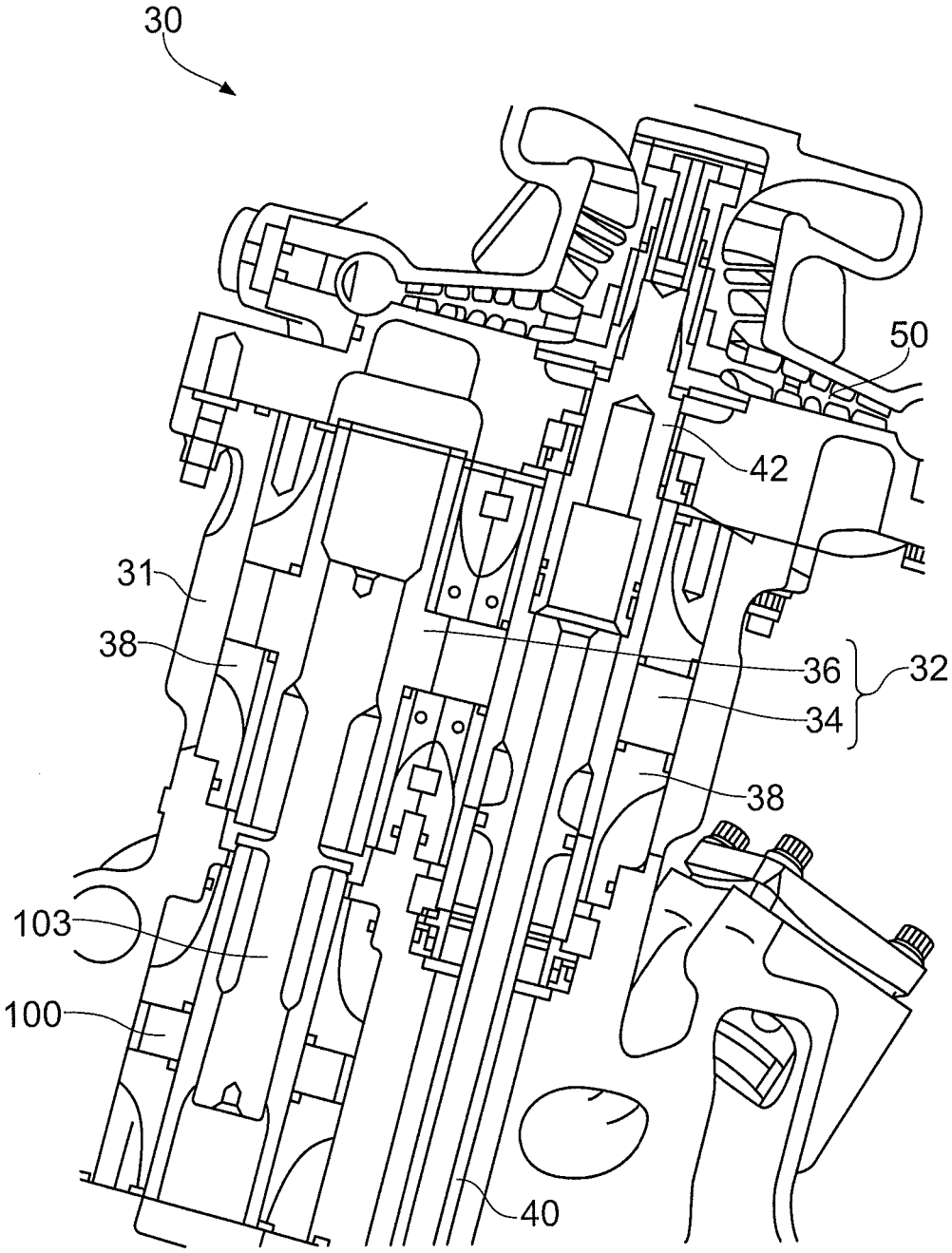
FIG. 1 shows schematically a cross-section through part of a fuel pumping unit.
Figure 2:
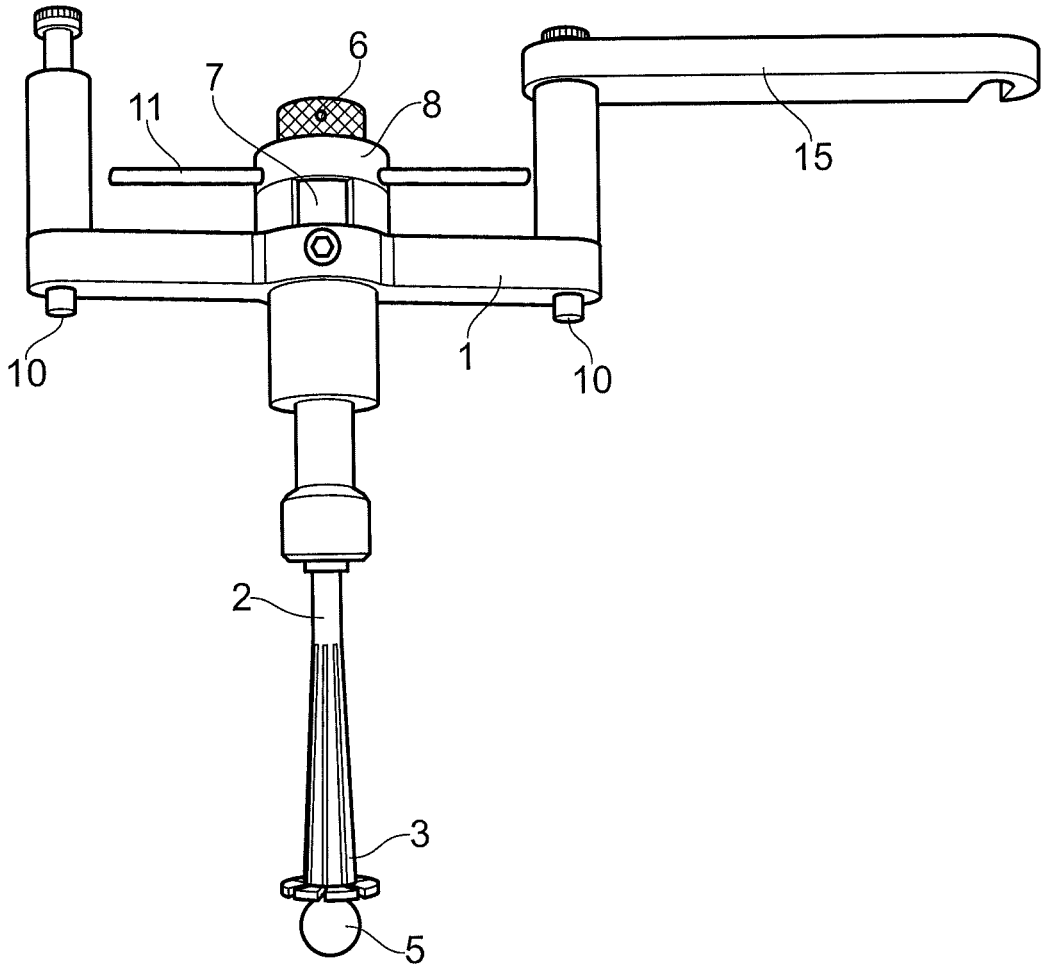
FIG. 2 shows schematically a side view of a tool for extracting an annular carbon face seal from a bore of a fuel pumping unit.

FIG. 2 shows schematically a side view of a tool for extracting an annular CFS from a bore of a fuel pumping unit. The tool has a support arrangement 1 in the form of a central body with two locating arms extending from opposite side thereof. The tool further has an extraction tube 2 with a multi-legged (e.g. six- or eight-legged)) collet 3 at the distal end thereof. The extraction tube 2 passes through an aperture formed in the central body of the support arrangement 1. The tool also has an elongate member in the form of a rod 4 (hidden by the extraction tube 2 in FIG. 2, but shown in FIG. 4 discussed below) which extends along the central passage of the extraction tube 2. A wedge element in the form of a ball 5 at the distal end of the rod 4 is located at a mouth of the collet 3. The ball 5 has a diameter which depends on the internal diameter of the CFS.

The rod 4 has an external thread which engages with an internal thread of the extraction tube 2. A first dial 6 for rotating the rod is formed at the proximal end of the rod 4 where it projects from the central passage of the extraction tube 2.

An internally threaded second dial 8 at the proximal end of the extraction tube 2 engages with an external thread 7 of the extraction tube, the second dial abutting the central body of the support arrangement. Bars 11 project from the second dial 8 to assist its rotation.

In use the tool is set ready for operation by turning the second dial 8 to a predetermined position. The first dial 6 is then turned fully clockwise to stop against the proximal end of the extraction tube 2. Following this, the second dial 8 is rotated fully counter-clockwise so that it abuts the first dial 6.

Figure 3:
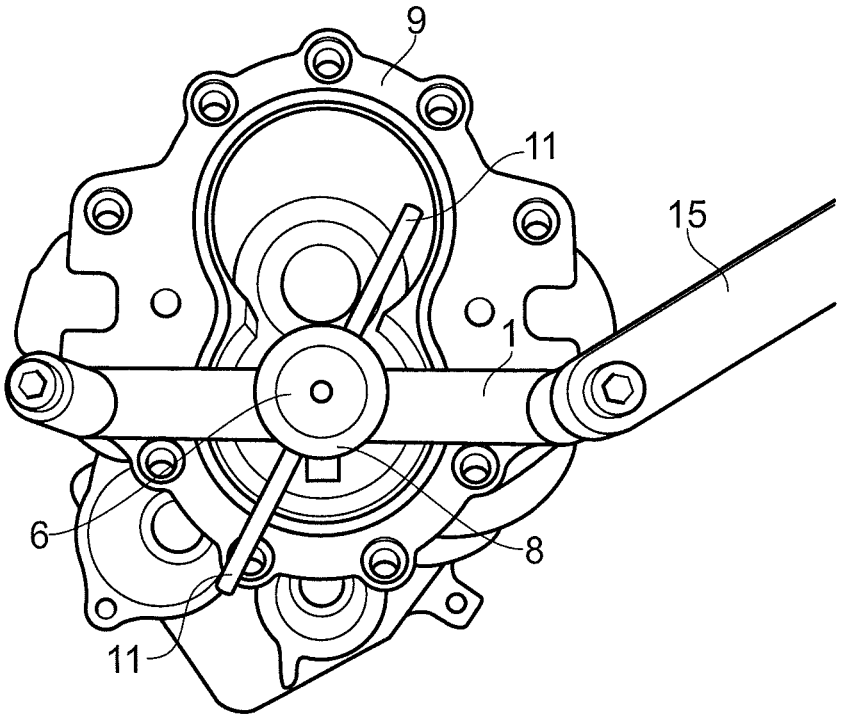
FIG. 3 shows a top view of the tool of FIG. 2 inserted in the bore of the fuel pumping unit.

The extraction tube 2 is inserted into the bore of the fuel pumping unit, as shown in the top view of FIG. 3. The locating arms of the support arrangement 1 rest on the casing 9 of the pumping unit, an engagement formation in the shape of pins 10 at the ends of the locating arms of the support arrangement 1 engaging with matching holes in the pump casing to prevent rotation of the support arrangement.

Figure 4:
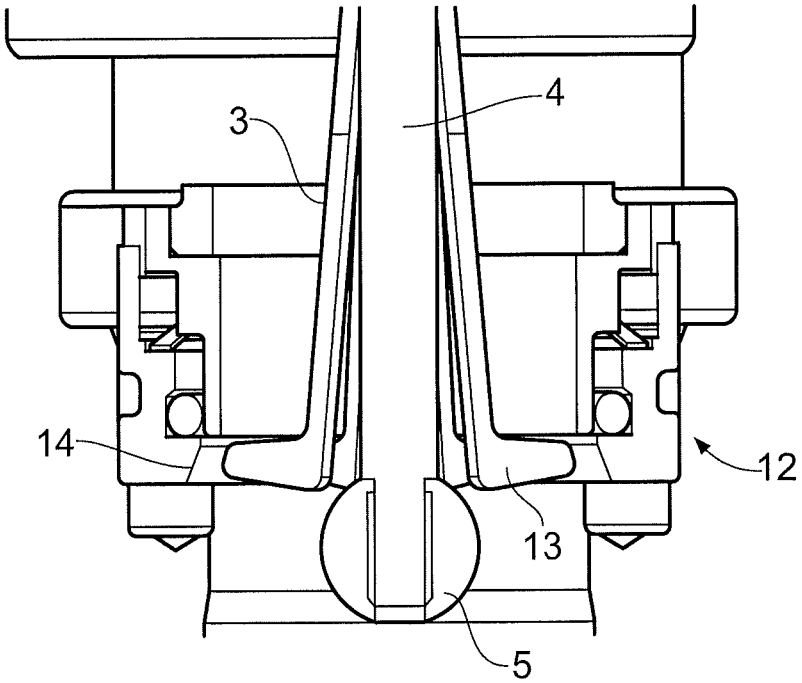
FIG. 4 shows schematically a close-up cross-sectional view of a collet of the tool of FIG. 2 located within the seal.

Next, if necessary, the second dial 8 may be rotated to move the extraction tube 2 along the bore a short distance to axially align the collet 3 with the CFS. FIG. 4 shows schematically a close-up cross-sectional view of the collet 3 located within the CFS 12. Each leg of the collet 3 has an outwardly projecting portion 13 which, in the axially aligned state, faces a circumferential recess 14 formed in the inner surface of the CFS 12.

Figure 5:
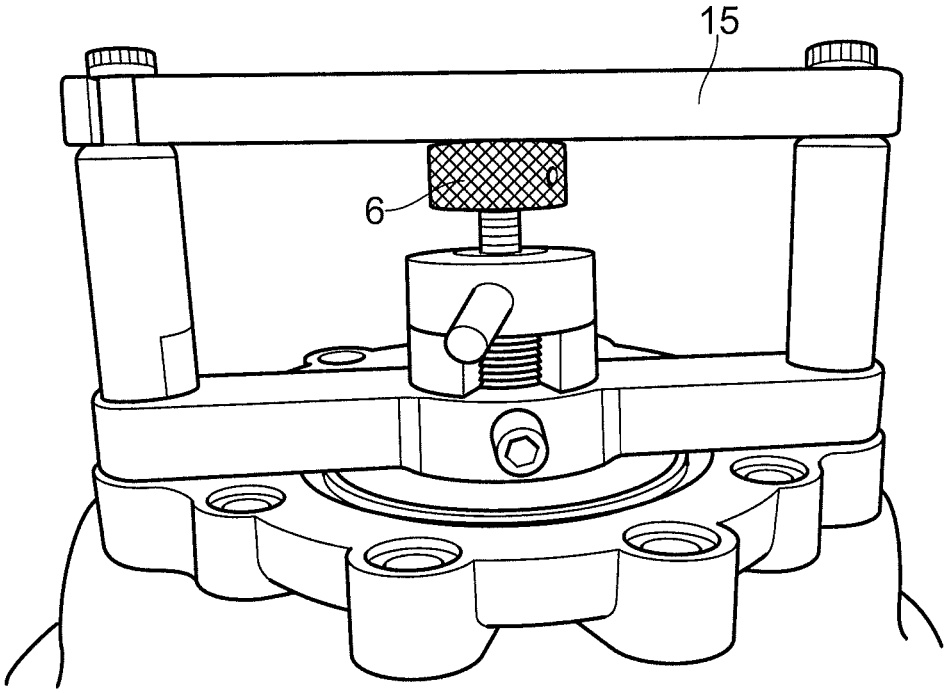
FIG. 5 shows a side view of the tool of FIG. 2 inserted in the bore of the fuel pumping unit.

The first dial 6 is then turned counter-clockwise to raise the dial 6 above the proximal end of the extraction tube 2 by typically about 10 to 12 mm. This pulls the rod 4 out of the extraction tube by the same amount and forces the ball 5 into the collet 3, which is wedged open by the ball to grip the CFS 12 at the recess 14. At this stage, a spacer collar (not shown) can be located between dials 6, 8 to ensure that the collet 3 maintains its expanded configuration. As shown in FIG. 5, the tool may have a stop arrangement in the form of a bridge 15 that can be swung above the dials 6, 8 to prevent the first dial 6 from turning further when the correct amount of collet expansion is achieved.

Figure 6:
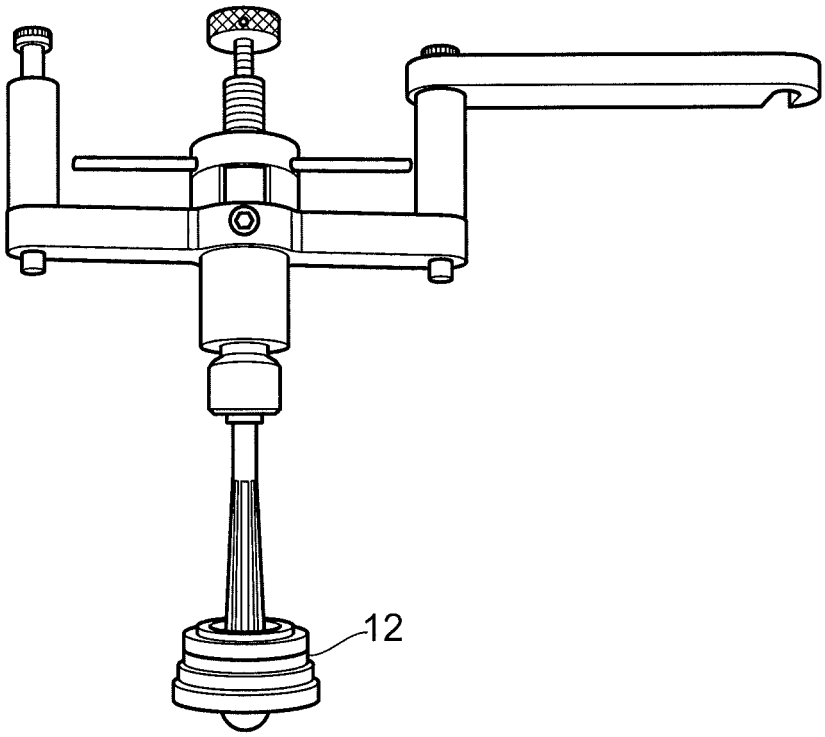
FIG. 6 shows a side view of the tool of FIG. 2 having extracted the seal.

Next, the second dial 8 is rotated clockwise to pull the extraction tube 2 out of the bore of the pumping unit, bringing the CFS 12 with it, gripped by the collet 3. The axial extraction force applied by the extraction tube 2 is reacted into the casing 9 of the pumping unit by the support arrangement 1. FIG. 6 shows a side view of the tool having extracted the CFS 12, which is still gripped by the collet 3.

Advantageously, the tool, by applying the axial extraction force, pulls the CFS 12 out of the bore without a "walking out" extraction process which can cause damage to the CFS 12 and the bore.

The extracted CFS 12 is released from the tool by turning the first dial 6 clockwise to contract the collet 3.

The tool can be configured to reduce the potential for damage to the CFS 12 and/or failure of the tool. For example, the legs of the collet can be made sufficiently long (typically about 50 to 60 mm long) to avoid high stress concentrations at the ends of the legs which could lead to leg fracturing. As another example, having more legs in the collet 3 helps to increase the contact area between the collet 3 and the CFS 12.

While the invention has been described in conjunction with the exemplary embodiments described above, many equivalent modifications and variations will be apparent to those skilled in the art when given this disclosure. For example, rather than having the ball 5 fixed to the end of the rod 4 and a screw thread between the rod 4 and the extraction tube 2, the rod can be allowed to turn freely in the extraction tube and a screw thread can be provided between the rod and a wedge element which takes the place of the ball. If the wedge element is constrained by an engagement formation which engages with a complimentary formation of the collet to prevent rotation of the wedge element in the collet, then rotation of the first dial causes the wedge element to screw up the rod as it is turned, thereby expanding the collet. As another example, the dials 6, 8 can be replaced by other suitable rotatable actuators. Accordingly, the exemplary embodiments of the invention set forth above are considered to be illustrative and not limiting. Various changes to the described embodiments may be made without departing from the spirit and scope of the invention.

What is claimed is:

1. A tool for extracting an annular carbon face seal from a bore of equipment in which the seal is installed, the tool comprising:

an extraction tube having a proximal end and a distal end, the extraction tube being for insertion into the bore at an entrance of the bore, such that, when the extraction tube is fully inserted into the bore, the proximal end of the extraction tube is disposed at the entrance of the bore;

a multi-legged collet formed at the distal end of the extraction tube, the collet being located within the seal when the extraction tube is fully inserted into the bore, each leg of the collet having a radially outwardly projecting portion that grips a recessed inner surface of the seal when the collet is expanded;

an elongate member extending along a central passage of the extraction tube, the elongate member having a proximal end accessible at the proximal end of the extraction tube;

a wedge element provided at a distal end of the elongate member, the wedge element being located at a mouth of the collet, the wedge element having a substantially spherical contact surface configured to contact the collet;

a support arrangement for reacting an axial extraction force applied to the extraction tube to the equipment;

a rotatable first actuator located at the proximal end of the elongate member, the first actuator being configured to actuate to cause the wedge element to be pulled into the collet, thereby expanding the collet to cause the collet to grip an inner surface of the seal;

a second actuator operatively connecting the extraction tube and the support arrangement, the second actuator being configured to actuate to cause the axial extraction force to be applied to the extraction tube, whereby the extraction force that is reacted to the equipment, extracts the seal from the bore when the seal is gripped by the collet; and a spacer collar positionable between the first actuator and the proximal end of the extraction tube when the collet is fully expanded, wherein the elongate member and the extraction tube are connected by a threaded connection, such that rotation of the first actuator causes: (i) the wedge element to be pulled into collet, thereby expanding the collet and causing the collet to grip the inner surface of the seal, (ii) the elongate member to be pulled out of the extraction tube, and (iii) the wedge element to rotate in the collet.

2. The tool according to claim 1, wherein the collet has at least four circumferentially arranged legs.

3. The tool according to claim 1, wherein the second actuator is a rotatable second actuator that is threadingly connected to the extraction tube, the second actuator being in a fixed axial relationship with the support arrangement such that rotation of the second actuator causes the axial extraction force to be applied to the extraction tube.

4. The tool according to claim 1, wherein the support arrangement has an engagement formation configured to engage with the equipment and prevent rotation of the support arrangement relative to the equipment.

5. The tool according to claim 1, further comprising a stop arrangement configured to prevent the first actuator from actuating further when a correct amount of collet expansion is achieved.

6. A method of using the tool according to claim 1, wherein the tool extracts the annular carbon face seal from the bore of the equipment in which the seal is installed.

* * * * *